US006396364B1

(12) United States Patent
Qvist

(10) Patent No.: US 6,396,364 B1
(45) Date of Patent: May 28, 2002

(54) BROADBAND MICROSTRIP-WAVEGUIDE JUNCTION

(75) Inventor: Anders Qvist, Kungsbacka (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/467,950

(22) Filed: Dec. 21, 1999

(30) Foreign Application Priority Data

Dec. 22, 1998 (SE) ..... 9804512

(51) Int. Cl.[7] ..... H01P 5/107
(52) U.S. Cl. ..... 333/26; 333/33
(58) Field of Search ..... 333/26, 33

(56) References Cited

U.S. PATENT DOCUMENTS

| | | | | |
|---|---|---|---|---|
| 2,829,348 A | * | 4/1958 | Kostriza et al. | 333/26 |
| 4,453,142 A | | 6/1984 | Murphy | 333/26 |
| 4,562,416 A | | 12/1985 | Sedivec | 333/26 |
| 4,901,040 A | | 2/1990 | Ahlborn et al. | 333/26 |
| 5,235,300 A | * | 8/1993 | Chan et al. | 333/26 X |

FOREIGN PATENT DOCUMENTS

| | | | | |
|---|---|---|---|---|
| EP | 0 905 814 A2 | | 5/1997 | |
| JP | 37803 | * | 2/1990 | 333/26 |
| JP | 5-90806 | | 4/1993 | |
| JP | 5-160611 | | 6/1993 | |
| SU | 1513545 A1 | | 10/1989 | |
| SU | 1675975 A1 | | 9/1991 | |

OTHER PUBLICATIONS

International Search Report; Date of Completion: Jul. 12, 1999 Date Mailed: Jul. 21, 1999.

* cited by examiner

*Primary Examiner*—Benny T. Lee
(74) *Attorney, Agent, or Firm*—Burns, Doane, Swecker & Mathis, L.L.P.

(57) ABSTRACT

The present invention relates to the field of microwave transitions between a microstrip and a waveguide. With the intention of obtaining a broadband and trimming-free junction, the junction is comprised of a pad which has an underside and an upper side located on respective sides of a tongue that extends into the waveguide. The underside is in contact with the upper side through the medium of a metal layer applied to the edge of the tongue. The upper side is, in turn, connected to the microstrip line which extends to other electronic equipment. Because the two sides can be adapted for different frequencies, the junction can be given a broader band and will also be trimming-free, since it is insensitive to mechanical tolerances.

4 Claims, 3 Drawing Sheets

BROADBAND MICROSTRIP-WAVEGUIDE JUNCTION

This application claims priority under 35 U.S.C. §§119 and/or 365 to 9804512-3 filed in Sweden on Dec. 22, 1998; the entire content of which is hereby incorporated by reference.

FIELD OF INVENTION

The present invention relates to the field of microwave technology, and more specifically to an arrangement for broadband transition between a microstrip and a waveguide.

BACKGROUND ART

Microwaves are electromagnetic waves that have very short wavelengths whose frequencies are usually defined as lying between 1 and 100 GHz (in other words, wavelengths in the range of 0.3 to 30 cm). They are utilized in different technical applications, for instance in microwave ovens, radar and telecommunications. A common feature of the two latter applications is that microwaves are often transmitted and received by one or more antennas.

Microwaves are often modulated and otherwise processed in special circuits, so-called monolithic microwave integrated circuits (MMIC). These circuits are normally disposed on or in substrates with microstrip lines for internal transmission. The substrates are similar to typical circuit boards although adapted in different ways, particularly for microwaves. For instance, the microstrip lines are dimensioned for the frequency or frequencies for which they are intended. The transmission of microwaves between different equipment components is often effected in waveguides. A waveguide is essentially a tube between whose conductive walls the microwaves can be said to bounce forwards in the direction of the tube. The waveguides have several good microwave transmission properties, such as low transmission losses, and allow filters to be readily incorporated therein, among other things.

Some type of junction is required in order to enable microwaves to be transferred between substrate and waveguide. Since the invention relates to such a junction between a microstrip and a waveguide, it is this type of junction that is described in the following.

Earlier known junctions between microstrip and waveguide can be described roughly as follows. A narrow substrate tongue is inserted sideways into one end of the waveguide. The end of the tongue carries a so-called pad, which consists of an often square substrate coating, which transfers signals between the microstrip and the waveguide. In order to obtain the best possible junction, it is important to adapt the pad to those frequencies at which it shall operate. The parameters that determine primarily the effectiveness of such adaptation are the length and width of the pad and the extent to which it enters the waveguide.

The aforedescribed junction normally has a narrow band but is well matched. The bandwidth of the junction is normally about 10–15%, i.e. the junction functions for a frequency band whose width is 10–15% of the frequency for which the junction is designed. The frequency band spreads centrally around this frequency.

One problem occurring with a narrowband junction is that it becomes sensitive to mechanical tolerances of the various components and also to mounting tolerances. This often requires the junction to be trimmed in order for it to function effectively. In the worst case, this sensitivity may mean that the junction will not function at all at the contemplated frequency.

SUMMARY OF THE INVENTION

The present invention addresses the problem of improving the effectiveness of microstrip-waveguide junctions.

One object of the present invention is therefore to provide a microstrip-waveguide junction that has a wider band than earlier known junctions.

Another object is to provide a microstrip-waveguide junction that will not need to be trimmed.

In brief, the invention is generally characterised in that the pad carried by the tongue inserted into the waveguide includes two signal transferring parts. These parts are situated on the upper side and lower side of the tongue respectively. The underside of the tongue is in electric contact with the upper side thereof, so that signals can be sent to and received from the microstrip. The two sides of the tongue are therewith designed for different, often mutually adjacent frequencies, so that they can cover a broader frequency band than a simple pad. Such a junction will also be less sensitive to different tolerances.

The invention will now be described in more detail with reference to preferred exemplifying embodiments thereof and also with reference to the accompanying drawings.

DESCRIPTION OF PREFERRED EMBODIMENTS

Figure 1:
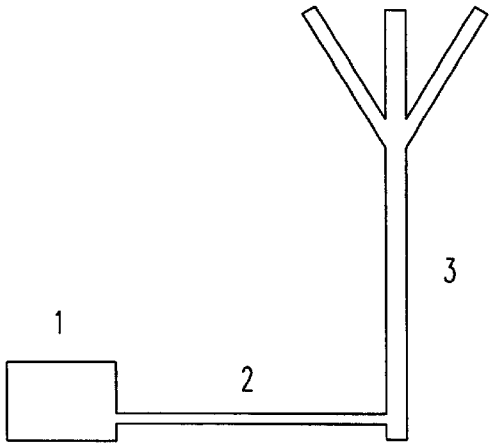
FIG. 1 is a simplified illustration of electronic equipment, a waveguide and an antenna with which the invention can be used.

FIG. 1 is intended to illustrate one area of use of a waveguide: radio communications equipment. Reference numeral 1 identifies electronic equipment for radio communication situated at a given distance from an antenna 3. In the illustrated case, a waveguide 2 is used to couple the equipment 1 to the antenna 3.

Figure 2:
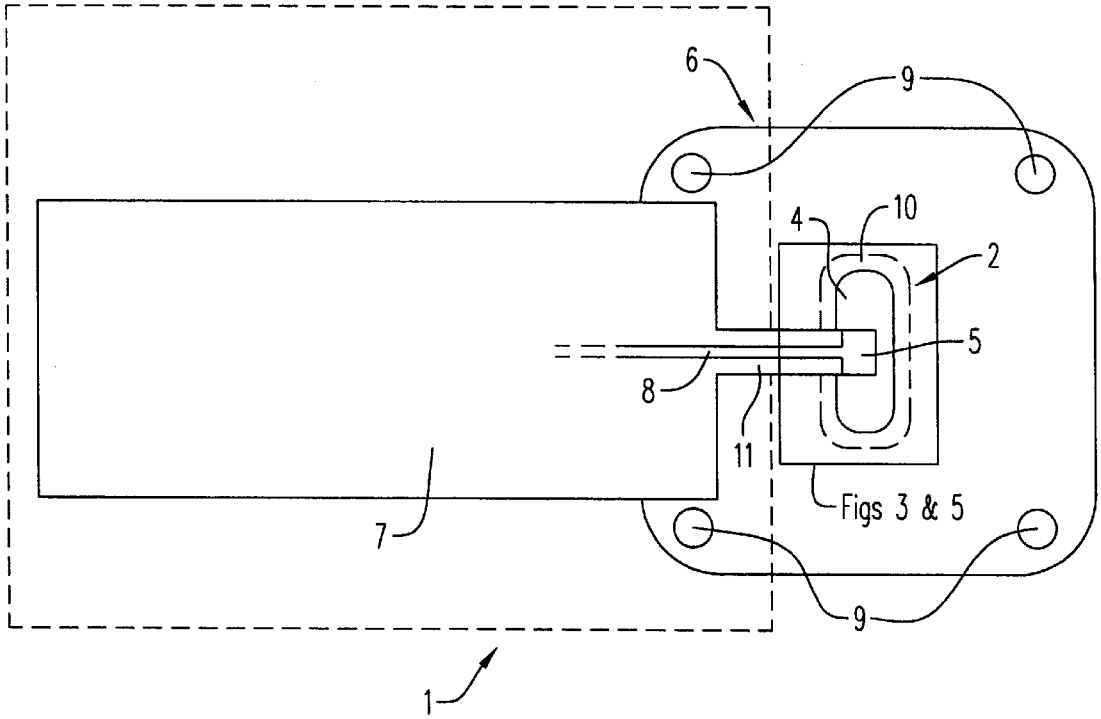
FIG. 2 illustrates an arrangement according to the invention: a microstrip-waveguide junction.
Figure 5:
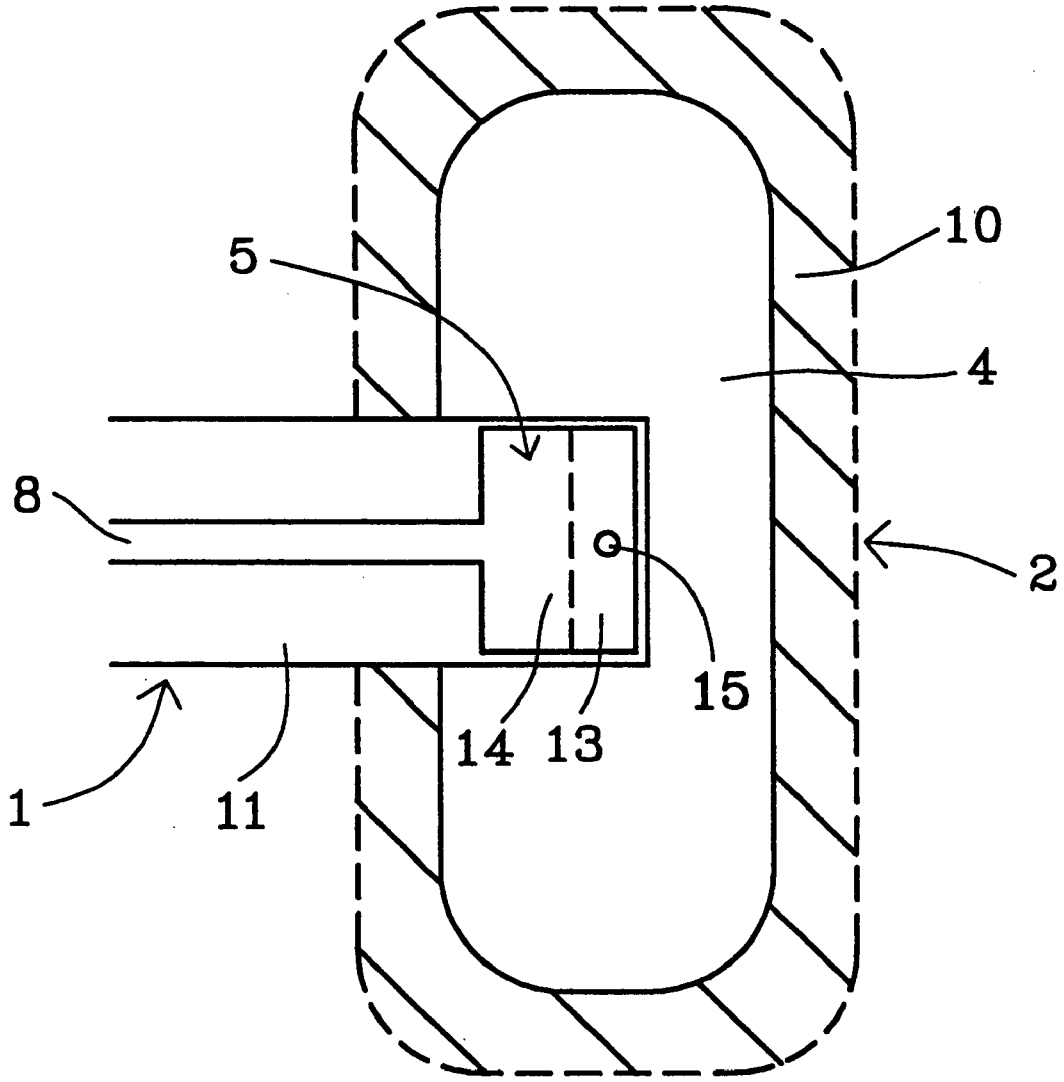
FIG. 5 is a view similar to that in FIG. 3 and illustrates another embodiment of the inventive arrangement.

FIG. 2 shows the junction between electronic equipment 1 and waveguide 2. The electronic equipment 1 includes a substrate 7 on which a microstrip line 8 extends to a pad 5 placed on a tongue 11 that protrudes out from the substrate 7. The fact that the whole of the tongue 11 and the pad 5 is included in the electronic equipment is not shown in this figure, for the sake of clarity. Neither does this figure show more of the pattern on the substrate 7 than the microstrip line 8. The underside of the substrate is normally provided with a ground plane. The portion of FIG. 2 circumscribed by the box labeled "FIGS. 3 & 5" is shown in FIGS. 3 and 5.

The pad 5 is inserted into one end of the waveguide 2, which in the illustrated case begins in the plane of the paper and is directed inwards. The waveguide 2 includes a metal wall 10 which surrounds a cavity 4 in which the microwave propagate. The dimensions of the waveguides, i.e. its height and width, are normally adapted in a known manner to those frequencies and modes for which the waveguide 2 is intended.

One end of the waveguide 2 is provided with an attachment plate 6 to which the substrate 7 is fastened. The attachment plate 6 includes a number of screw holes 9 or the like by means of which a metallic cover (not shown) in fastened. The cover functions as a short circuiting plane, which is necessary in achieving good matching of the junction. The distance between the cover and the microstrip line 8 normally corresponds to a quarter wavelength of the frequency for which the junction is primarily intended.

Figure 3:
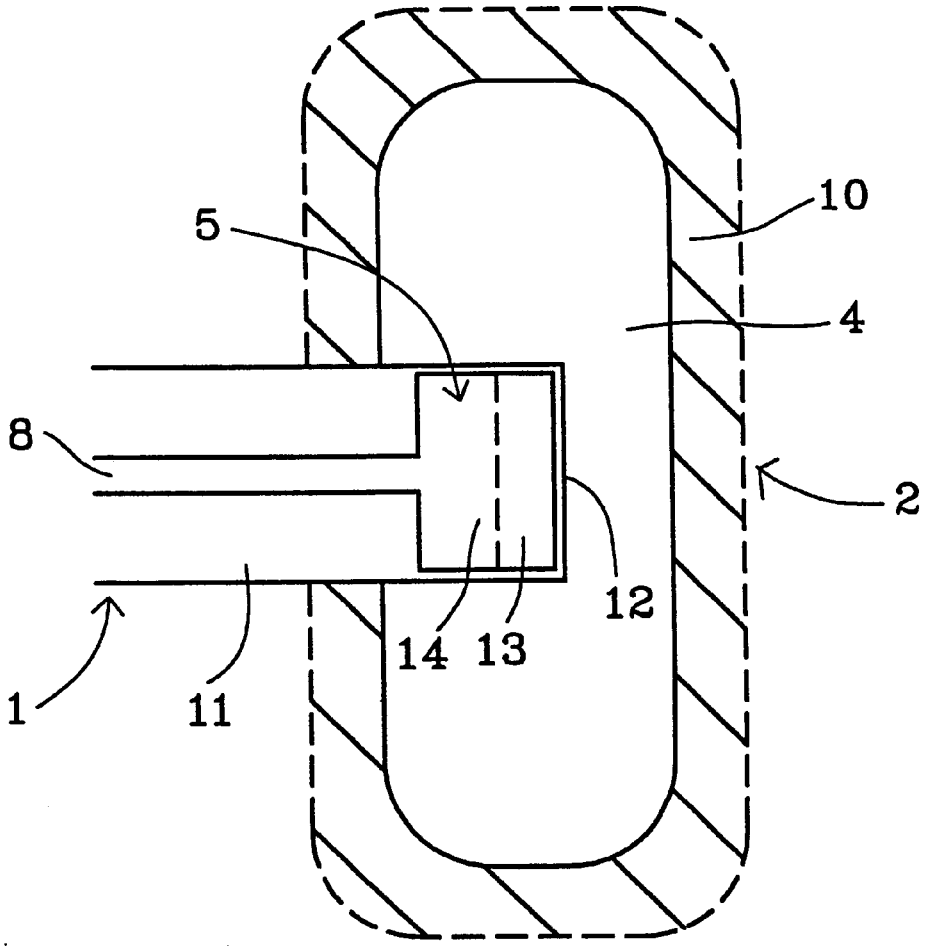
FIG. 3 illustrates an embodiment of the inventive arrangement.

FIG. 3 illustrates one embodiment of the inventive arrangement. Similar to the FIG. 2 illustration, FIG. 3 shows the waveguide 2 comprising the metal wall 10 and the cavity 4, and also shows part of the electronic equipment 1 including the tongue 11, microstrip line 8 and pad 5. The inventive arrangement includes the underside 13 of the pad 5 placed on the opposite side of the tongue 11. The underside 13 of the pad 5 is in electrical contact with the upper side 14 thereof via a metallic layer 12, which is normally placed generally on the front edge of the tongue 11. The upper side 14 and the underside 13 of the pad are normally constructed primarily to be matched to an individual particular frequency, these frequencies often lying relatively close to one another.

Figure 4:
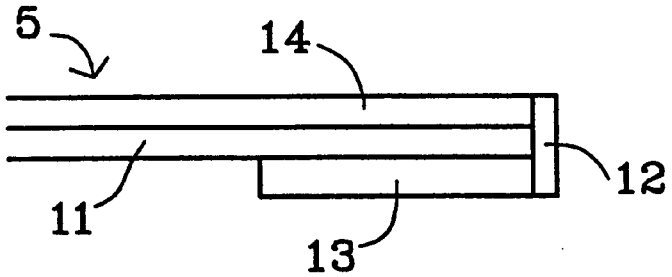
FIG. 4 is a side view of part of said inventive arrangement.

FIG. 4 illustrates the aforedescribed embodiment of the inventive arrangement in more detail from one side; the pad 5 of the FIG. 3 illustration is shown in a close-up view. As will be seen from this Figure, the pad 5 includes two substrate layers, i.e. an upper side 14 and an underside 13. Each of these two sides 13, 14 is situated on a respective side of the tongue 11. A metal layer 12, placed for instance on the short side of the tongue 11, forms an electric contact between the sides 13, 14.

FIG. 5 is a view similar to that of FIG. 3 and shows another embodiment of the inventive arrangement. Some elements labeled in both FIG. 3 and FIG. 5 are described above in connection with FIG. 3. The difference between the embodiments is that the electric contact between the upper side 14 and the underside 13 of the FIG. 5 embodiment is established by at least one via 15, i.e. through the medium of an electrically conductive element which passes through the tongue 11 and which is in electric contact with said sides 13, 14.

Because the pad 5 has an upper side 14 and an underside 13 that can each be adapted to a particular frequency, the junction can be adapted to two frequencies. As before mentioned, the bandwidth of a respective one side is about 10–15%. When the sides 13 and 14 are adapted for relatively close or adjacent frequencies, these frequency bands may overlap, such that the total bandwidth of the junction may be twice as large. The junction will therewith be less sensitive to different tolerances, which make the junction insensitive and trimming-free.

It will be understood that the invention is not restricted to the aforedescribed and illustrated exemplifying embodiments thereof and that modifications can be made within the scope of the following claims.

What is claimed is:

1. A microstrip and waveguide junction comprising a substrate that includes a tongue which is inserted into a waveguide and which has a coating in the form of a pad, wherein the pad includes more than one part, each of which is intended for transmission purposes, wherein said parts are situated on respective different sides of the tongue.

2. The waveguide junction according to claim 1, wherein the pad is arranged centrally in the waveguide.

3. A microstrip and waveguide junction according to claim 1, wherein the different sides are interconnected electrically through the medium of a via.

4. A microstrip and waveguide junction according to claim 1, wherein the different sides are interconnected electrically by means of a metal layer applied to at least a part of one edge of the substrate.

* * * * *